US006353716B1

(12) United States Patent
Uehara et al.

(10) Patent No.: US 6,353,716 B1
(45) Date of Patent: Mar. 5, 2002

(54) IMAGE FORMING APPARATUS HAVING HUMIDITY DETECTION AND TONER CONCENTRATION ADJUSTING ACCORDING TO DETECTED HUMIDITY

(75) Inventors: Makoto Uehara, Nara; Yasutaka Maeda, Kyoto; Ken Yamagishi, Yamatotakada; Masayasu Narimatsu, Nara; Hiroji Kawamoto, Tenri; Yuka Sakagami, Nara; Tomoe Matsuoka, Yamatokoriyama, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/667,591

(22) Filed: Sep. 22, 2000

(30) Foreign Application Priority Data

Sep. 22, 1999 (JP) ..... 11-268055
Sep. 22, 1999 (JP) ..... 11-268056

(51) Int. Cl.[7] ..... G03G 15/00
(52) U.S. Cl. ..... 399/44; 399/62
(58) Field of Search ..... 399/44, 58, 59, 399/61, 62, 63, 64, 65, 97

(56) References Cited

U.S. PATENT DOCUMENTS 4,758,861 A * 7/1988 Nakamaru et al. ..... 399/59
5,038,175 A * 8/1991 Sohmiya et al. ..... 399/58
5,146,273 A * 9/1992 Yamada ..... 399/31
5,237,374 A 8/1993 Ueno et al.
5,311,256 A * 5/1994 Hamamichi et al. ..... 399/44
5,579,091 A * 11/1996 Yamada et al. ..... 399/59
5,915,074 A 6/1999 Shimazawa et al.
5,915,143 A * 6/1999 Watanabe et al. ..... 399/44
5,987,272 A * 11/1999 Maeda et al. ..... 399/58

FOREIGN PATENT DOCUMENTS

JP 6084557 5/1985
JP 03-200176 * 9/1991
JP 412380 1/1992
JP 08-076583 * 3/1996

* cited by examiner

*Primary Examiner*—Robert Beatty

(57) ABSTRACT

An image forming apparatus including a developing unit for stocking a developing agent containing toner and forming a toner image on a photosensitive medium with the developing agent, a toner supply unit for supplying the toner to the developing unit, a toner specific concentration detecting unit for detecting the toner specific concentration of the developing agent stocked in the developing unit, a humidity detecting unit for detecting humidity in the neighborhood of the developing unit, a storage unit for storing the humidity information detected by the humidity detecting unit, and a toner specific concentration correcting unit for controlling the toner supply amount of the toner supply unit on the basis of the humidity information stored to correct the toner specific concentration, wherein the toner specific concentration correcting unit compares newly-detected humidity with reference humidity corresponding to the humidity which is detected at the time when the developing agent is stocked into the developing unit or exchanged by new developing agent and which is stored in the storage unit, and corrects the toner specific concentration in accordance with the comparison result.

14 Claims, 9 Drawing Sheets

IMAGE FORMING APPARATUS HAVING HUMIDITY DETECTION AND TONER CONCENTRATION ADJUSTING ACCORDING TO DETECTED HUMIDITY

CROSS-REFERENCE TO RELATED APPLICATION

This application is related to Japanese Patent Applications No. Hei 11(1999)-268055 filed on Sep. 22, 1999 and Hei 11(1999)-268056 filed on Sep. 22, 1999, whose priorities are claimed under 35 USC §119, the disclosure of which is incorporated by reference in its entirety.

BACKGROUND OF THE INVENTION

1. Field of the Invention

The present invention relates to an image forming apparatus such as an electrophotographic type copying machine, laser beam printer, facsimile machine or the like which uses two-component developing agent comprising toner and carriers, and particularly to an image forming apparatus which can correct the specific concentration of toner in accordance with variation of humidity to stably form an image.

2. Description of the Related Art

A conventional image forming apparatus is equipped with a photosensitive drum for carrying an electrostatic latent image thereon, which is disposed in the housing of the apparatus. The surface of the photosensitive drum is uniformly electrified by an electrifying unit, and then an electrostatic latent image is formed on the surface of the photosensitive drum thus electrified. The electrostatic latent image formed on the surface of the photosensitive drum is developed with toner by a developing unit to form a toner image. The toner image is transferred onto a sheet serving as a transfer medium fed to a transfer unit.

Subsequently, the sheet is peeled off from the photosensitive drum by a peeling unit and then the toner image is fixed onto the sheet by a fixing unit. In such a conventional image forming apparatus, two-component developing agent comprising toner and carriers is used as developing agent of the developing unit. The toner is formed by dispersing colored pigment into resin, and the carriers are composed of ferromagnetic particles, for example, iron powder or the like. In the two-component developing agent comprising the toner and the carriers thus formed, the weight ratio (weight percentage) of the toner is equal to several %, and the toner of the developing agent is wasted every time an electrostatic latent image on the photosensitive drum is developed. Accordingly, the weight ratio of the toner in the developing agent, that is, the specific concentration of the toner must be kept in a predetermined range.

FIG. 7 is a block diagram showing a circuit for controlling the specific concentration of toner in the conventional image forming apparatus, and FIGS. 8 and 9 are graphs showing the output characteristics of an auto toner control sensor (hereinafter referred to as "ATC sensor") for the toner specific concentration.

As shown in FIG. 7, the toner specific concentration of the developing agent in a developing unit 101 is detected by a magnetic type ATC sensor 102, and CPU 103 controls toner supply from a toner cartridge 104 in accordance with detection information of the ATC sensor 102.

FIG. 8 shows the relationship between the toner specific concentration and the output value of the ATC sensor 102. When reduction of the toner specific concentration of the developing agent in the developing unit 101 is detected on the basis of the output value of the ATC sensor 102 by the CPU 103, CPU 103 drives a toner cartridge driving motor 106 to supplement toner into the developing unit through the toner cartridge 104. As a result of the toner supplement, the toner specific concentration increases, and the output voltage from the ATC sensor 102 is reduced. For example when the output voltage of the ATC sensor 102 is reduced to be less than a reference value V0 shown in FIG. 8 (for example, 2V), CPU 103 stops the driving motor 106 to stop the toner supplement from the toner cartridge 104, whereby the toner specific concentration of the developing agent in the developing unit 101 is kept to 4 wt % (reference value V0), for example.

The two-component developing agent in the developing unit 101 is liable to be influenced by humidity. Therefore, if no correction is carried out on the toner specific concentration in accordance with variation of humidity, the toner specific concentration increases as the atmosphere is more humid. On the other hand, the toner specific concentration is reduced as the atmosphere is less humid. This phenomenon occurs because the ATC sensor 102 detects the magnetic flux density to control the toner specific concentration. For example, when the atmosphere is more humid, the electrification amount of the developing agent is lowered, and the developing agent is kept more tight as a whole. Therefore, the ATC sensor 102 judges that the density of the carriers is high, that is, the toner specific concentration is low, and thus instructs to start the toner supplement.

On the other hand, when the atmosphere is less humid, the electrification amount of the developing agent is increased, and the developing agent is kept swollen. Therefore, the ATC sensor 102 judges that the density of the carriers is low, that is, the toner specific concentration is high, and thus instructs to stop the toner supply.

That is, the characteristic curve indicating the output of the ATC sensor of FIG. 8 is varied like a characteristic curve with respect to the variation of humidity as shown in FIG. 9. A stable image can not be obtained without correcting the above phenomenon Consequently, when the atmosphere is kept in a high humidity state, the toner specific concentration of the developing agent rises up or the electrification amount is lowered. Therefore, toner scattering or background fogging (which means increase of background density and thus the background looks dirty) or defacement of images occurs, so that the image quality is lowered. On the other hand, when the atmosphere is kept in a low humidity state, the toner specific concentration of the developing agent is reduced or the electrification amount is increased. Accordingly, the image density is lowered, and for example, blurring of characters occurs, so that the image quality is lowered.

Furthermore, the developing agent is deteriorated with time lapse due to increase of the copy amount (copy frequency) and also increase of the developing agent stirring time, and due to the deterioration of the developing agent, the toner specific concentration rises up or the electrification amount is lowered as compared with the toner specific concentration at the initial stage of the developing agent, that is, when the device is set up or the developing agent has been just exchanged. Therefore, toner scattering or background fogging, or image defacement occurs, and thus the image quality is lowered.

In order to solve the problem, according to an image forming apparatus disclosed in Japanese Unexamined Patent Publication No. Hei 4(1992)-12380, a humidity sensor 105 is provided as shown in FIG. 7. If the humidity (relative humidity) is 70% or more, the toner supplement amount is controlled by a controller 103*a* so that the toner specific concentration of the developing agent in the developing unit 1 is equal to a first reference value (for example, 3.5 wt %). On the other hand, if the humidity is below 40% or less, the toner supplement amount is controlled by the controller 103*a* so that the toner specific concentration of the developing agent in the developing unit 1 is equal to a second reference value (for example, 4.5 wt %) higher than the first reference value.

FIG. 10 shows the operating characteristic of the humidity sensor 105 in the image forming apparatus.

In the image forming apparatus as described above, a control reference value (target value) indicated by a line C of FIG. 10 is provided. That is, under the humidity of 40% or less, the toner specific concentration is controlled to be equal to 4.5 wt %, and under the humidity of 70% or more, the toner specific concentration is controlled to be equal to 3.5 wt %.

However, actually, the toner specific concentration is shifted as indicated by A-line or B-line of FIG. 10 with variation of the humidity. That is, in FIG. 10, the A-line and B-line indicate the variations of the toner specific concentration with humidity variation when the humidity is equal to 55% at the setup time and when the humidity is equal to 69% at the setup time, respectively. Accordingly, it is difficult to control the toner specific concentration to the humidity so that the toner specific concentration is coincident with the control reference value indicated by the C-line. Therefore, the image forming apparatus thus constructed have the following problem.

That is, when the humidity range in which the toner specific concentration is corrected is set to 40% or less and 70% or more in advance, the transition of the toner specific concentration when the humidity at the developing agent initial time is equal to 55% is expected as indicated by the A-line of FIG. 10, and the transition of the toner specific concentration when the humidity at the developing agent initial time is equal to 69% is expected as indicated by the B-line of FIG. 10.

Accordingly, in the case where the toner specific concentration value is stored through the ATC sensor 102 into CPU at the developing agent initial time, the toner specific concentration under the humidity of 55% is equal to the reference value of 4 wt % (A-line) when the toner specific concentration value is stored on the assumption that the humidity at the developing agent initial time is equal to 55% (hereinafter referred to as "55%-case"), and also equal to the reference value of 4 wt % under the humidity of 69% (B-line) when the toner specific concentration value is stored on the assumption that the humidity at the developing agent initial time is equal to 69% (hereinafter referred to as "69%-case").

When the humidity in each of the 55%-case and the 69%-case reaches 70%, the toner specific concentration in the 55%-case is equal to 3.5 wt % (A-line). However, even when humidity varies slightly, the toner specific concentration in the 69%-case must be corrected by the same amount, so that the toner specific concentration is set to 3 wt % (B-line).

As described above, when the image forming apparatus is set up or the developing agent is exchanged in the vicinity of the boundary between an area where the correction of the toner specific concentration should be carried out and an area where no correction of the toner specific concentration should be carried out, the toner specific concentration is greatly deviated from the reference toner specific concentration.

Furthermore, in the case where the toner specific concentration is corrected in accordance with the humidity variation, if the humidity is in the vicinity of the boundary between the area where the correction of the toner specific concentration is carried out and the area where the correction of the toner specific concentration is not carried out, the correction may be unintentionally carried out or not carried out due to a slight humidity variation. Therefore, the toner specific concentration is very unstable and thus it is difficult to achieve stable image quality.

For example, in the case where the image forming apparatus is set so that the toner specific concentration is corrected when the humidity is 70% or more, when the humidity varies like it is equal to 69% at a time, the next moment it varies to 70% and the next moment it varies to 69%, the toner specific concentration is carried out at some instantaneous time, but it is not carried out at the next instantaneous time, so that the toner specific concentration is very unstable.

Referring to FIG. 9, comparing both cases of 69% and 71% in humidity, the difference in toner specific concentration is equal to about 1 wt % between both cases. Therefore, if the correction of the toner specific concentration is carried out or not carried out every time the humidity varies by 1%, 2%, the toner specific concentration is very unstable.

In order to solve the above problem causing degradation of the image quality, Japanese Unexamined Patent Publication No. Sho 60(1985)-84557 discloses the following technique. According to this technique, the humidity sensor 105 is provided as shown in FIG. 7, and the variation of the toner specific concentration caused by the humidity variation is corrected by varying the reference value of the ATC output voltage in accordance with the variation of the humidity. In addition, the copy amount is counted, and when the copy amount thus counted reaches such a value that the developing agent is deteriorated and the output voltage of the ATC sensor is varied, the increment of the output voltage of the ATC sensor is added to the reference value of the output voltage of the ATC sensor to keep the toner specific concentration in the developing agent constant at all times. The copy amount is proportional to the stirring time of the developing agent, and the developing agent is deteriorated as the stirring time increases.

In the above publication, the reference value of the output voltage of the ATC sensor is shifted up in accordance with the copy amount to correct the toner specific concentration so that the toner specific concentration is kept constant, and also the correction is made so that the reference value of the output voltage of the ATC sensor is varied in accordance with the humidity variation. However, no consideration is paid to the time variation due to the copy amount, and the correction amount is determined on the basis of only the humidity variation.

That is, in the correction of the toner specific concentration as described above, even when the toner specific concentration is controlled to be constant, the correction amount for the humidity variation is not associated with the copy amount of the developing agent, but is kept constant as shown in FIG. 11 as the developing agent is deteriorated with increase of the stirring time of the developing agent (indicated by a broken line of FIG. 11), so that it is difficult to control the toner specific concentration constant for both of developing agent just after exchanged and developing agent which is being deteriorated.

FIG. 12 is a graph showing an example of the correction of the toner specific concentration in the conventional technique, and also shows the relationship between the toner specific concentration (wt %) and the ATC output value under three humid states (high humidity, normal humidity, low humidity). In this case, the toner specific concentration is corrected so that the ATC output reference V0 for controlling the toner specific concentration is shifted to Vb when the humidity is shifted to the high humidity side and to Vc when the humidity is shifted to the low humidity side.

However, since the correction amount is set to a fixed value over a use term of the developing agent (straight lines V0, Vb, Vc are in parallel to one another), the variation amount of the ATC output value at the low humidity side and the high humidity side is increased with increase of the stirring time of the developing agent as shown in FIG. 13 when the correction amount of the ATC output reference value at the high humidity side is set to +0.5V and the correction amount of the ATC output reference value at the low humidity side is set to −0.5V.

Accordingly, the correction amount of the ATC output reference value lacks. For example, in the case of the developing agent at the developing agent stirring time of 120 h in FIG. 13, the correction amount of the ATC output reference value runs short by +0.4V (variation value of +0.9V) at the high humidity side and by −0.4V (variation value of −0.9V) at the low humidity side. Consequently, at the high humidity side, the ATC sensor output value is shifted from a point Vb (toner specific concentration: 4 wt %) to a point Vb' (toner specific concentration: 4.4 wt %) and the toner specific concentration rises up by about 0.4 wt %. On the other hand, at the low humidity side, the ATC sensor output value is shifted from a point Vc (toner specific concentration: 4 wt %) to a point Vc' (toner specific concentration: 3.6 wt %), and the toner specific concentration is reduced by about 0.4 wt %.

That is, in the case where the correction amount based on the humidity is proper at the time when developing agent just after exchange is used, the correction amount runs short for developing agent which has been used at a high copy frequency (copy number). At this time, when the humidity state is shifted to the high humidity side, the toner specific concentration rises up, and when the humidity state is shifted to the lower humidity side, the toner specific concentration is reduced.

On the other hand, in the case where the correction amount based on the humidity is proper when developing agent progressing in deterioration is used, the correction amount is excessive for developing agent just after exchange. At this time, when the humidity state is shifted to the high humidity side, the toner specific concentration is reduced, and when the humidity state is shifted to the low humidity side, the toner specific concentration rises up. Accordingly, it is difficult to keep the toner specific concentration constant with respect to the humidity variation over the using term of the developing agent, and thus the toner specific concentration is unstable with the humidity variation.

Further, in a multicolor image forming apparatus having plural image forming units using plural kinds of developing agents, color balance is important particularly when a full-color image or the like is desired, and thus it is necessary to properly correct the toner specific concentration for each of the plural kinds of developing agents. Therefore, the above problem is more critical when the image density correction or the toner specific concentration correction is carried out at plural times for every color.

In view of the above problems, the present invention has been made to provide an image forming apparatus characterized in that the toner specific concentration can be kept stable at all times during the period of using the developing agent irrespective of the humidity variation, so that an excellent image quality can be stably attained.

SUMMARY OF THE INVENTION

According to the present invention, there is provided an image forming apparatus comprising: a developing unit for stocking a developing agent containing toner and forming a toner image on a photosensitive medium with the developing agent; a toner supply unit for supplying the toner to the developing unit; a toner specific concentration detecting unit for detecting the toner specific concentration of the developing agent stocked in the developing unit; a humidity detecting means for detecting humidity in the neighborhood of the developing unit; a storage means for storing the humidity information detected by the humidity detecting unit; and a toner specific concentration correcting unit for controlling the toner supply amount of the toner supply unit on the basis of the humidity information stored to correct the toner specific concentration, wherein the toner specific concentration correcting unit compares newly-detected humidity with reference humidity corresponding to the humidity which is detected at the time when the developing agent is stocked into the developing unit or exchanged by new developing agent and which is stored in the storage unit, and corrects the toner specific concentration in accordance with the comparison result.

That is, the humidity (relative humidity) at the time when the developing agent is stocked or exchanged by new developing agent is set as the reference humidity, and the correction amount of the toner specific concentration is set in accordance with the variation amount from the reference humidity, so that the toner specific concentration can be surely corrected in accordance with the humidity variation.

In the present invention, the developing agent stocking time or the developing agent exchange time means the time point when the image forming apparatus is newly set up and the developing agent is prepared or the time point when deteriorated developing agent is exchanged by new developing agent, respectively. Specifically, it means the time just after the toner seal is broken and toner is poured into a developing agent tank or the time period during which the developing agent containing the toner poured in the developing agent tank is stirred.

In the present invention, the developing unit comprises a developing portion for forming a toner image on the photosensitive medium with the developing agent, a toner cartridge which is hermetically sealed so as to be openable while the developing agent containing at least the toner is stocked therein, and a developing agent feeding portion (for example, screw conveyor) for feeding the toner in the opened toner cartridge to the developing portion. The toner specific concentration unit corrects the toner specific concentration on the basis of reference humidity corresponding to the humidity of the interior and/or the exterior of the image forming apparatus which is detected by the humidity detecting unit just after the toner cartridge is opened.

The image forming apparatus of the present invention is further equipped with a stirring unit for stirring the developing agent stocked in the developing unit. The storage unit stores a stirring time of the stirring unit and a toner specific concentration which is newly detected by the toner specific concentration detecting unit, and the toner specific concentration correcting unit corrects the toner specific concentration on the basis of the stirring time and the comparison result for the humidity, whereby the toner specific concentration correction amount for the humidity variation is determined in accordance with the developing agent stirring time from the initial time (for example, the apparatus setup time or the developing agent exchange time). Accordingly, irrespective of the stirring time of the developing agent, the toner specific concentration can be accurately corrected in accordance with the humidity variation at all times.

In the image forming apparatus of the present invention, the storage unit stores the humidity at the time when the toner specific concentration is corrected as new reference humidity, and the toner specific concentration correcting unit compares the new reference humidity with humidity which is newly detected after the toner specific concentration is corrected and corrects the toner specific concentration in accordance with the comparison result, whereby the toner specific concentration correction value can be determined in accordance with the humidity variation from the humidity information at the initial time as reference humidity. Therefore, irrespective of the humidity atmosphere at the initial time (for example, the apparatus setup time or the developing agent exchange time), the toner specific concentration can be accurately corrected.

Further, the image forming apparatus of the present invention further comprises a voltage applying unit for applying voltage to the developing agent stocked in the developing unit to adjust the density of the toner image, an image density detecting unit for detecting the density of the toner image, and an image density control means for comparing the image density detected by the image density detecting unit with a predetermined reference image density and setting the voltage applied by the voltage applying unit in accordance with the comparison result, wherein the storage unit stores the applied voltage thus set and the detected humidity as new reference humidity, and the toner specific concentration correcting unit compares the applied voltage newly detected by the image density control unit with the previous applied voltage to judge the voltage correction direction, compares the newly detected humidity with the previous humidity to judge the humidity variation direction, and corrects the toner specific concentration only when the voltage correction direction corresponds to the humidity variation direction, whereby the toner specific concentration can be corrected only when the correction is actually needed.

In the image forming apparatus, the storage unit stores the applied voltage at the toner specific concentration correction time as a reference applied voltage, and the toner specific concentration correcting unit compares the applied voltage value newly set by the image density control unit with the reference applied voltage, corrects the toner specific concentration in accordance with the comparison result, and renews the reference applied voltage on the basis of the applied voltage at the toner specific concentration time, whereby the toner specific concentration correction can be executed only when the correction is actually needed.

According to the image forming apparatus of the present invention, the toner specific concentration correcting unit corrects the toner specific concentration only when the comparison result for the humidity is larger than a predetermined difference, and thus there does not occur such a situation that the correction of the toner specific concentration is carried out or not carried out due to a slight humidity variation, and thus the toner specific concentration can be corrected stably.

In the prior art, the correction of the toner specific concentration is carried out on the basis of the copy amount (copy frequency). However, by correcting the toner specific concentration on the basis of the stirring time of the developing agent, the variation of the toner specific concentration can be effectively used while the image density correction result and the toner specific concentration correction result are associated with each other. Therefore, the developing agent stirring operation can be prevented from being unnecessarily executed because of unnecessary execution of the toner specific density correction or image density correction, and reduction of availability and waste of expendables can be prevented.

DETAILED DESCRIPTION OF THE PREFERRED EMBODIMENTS

A preferred embodiment of an image forming apparatus of the present invention will be described hereunder with reference to FIGS. 1 to 6, however, the present invention is not limited to the following embodiments.

Figure 1:
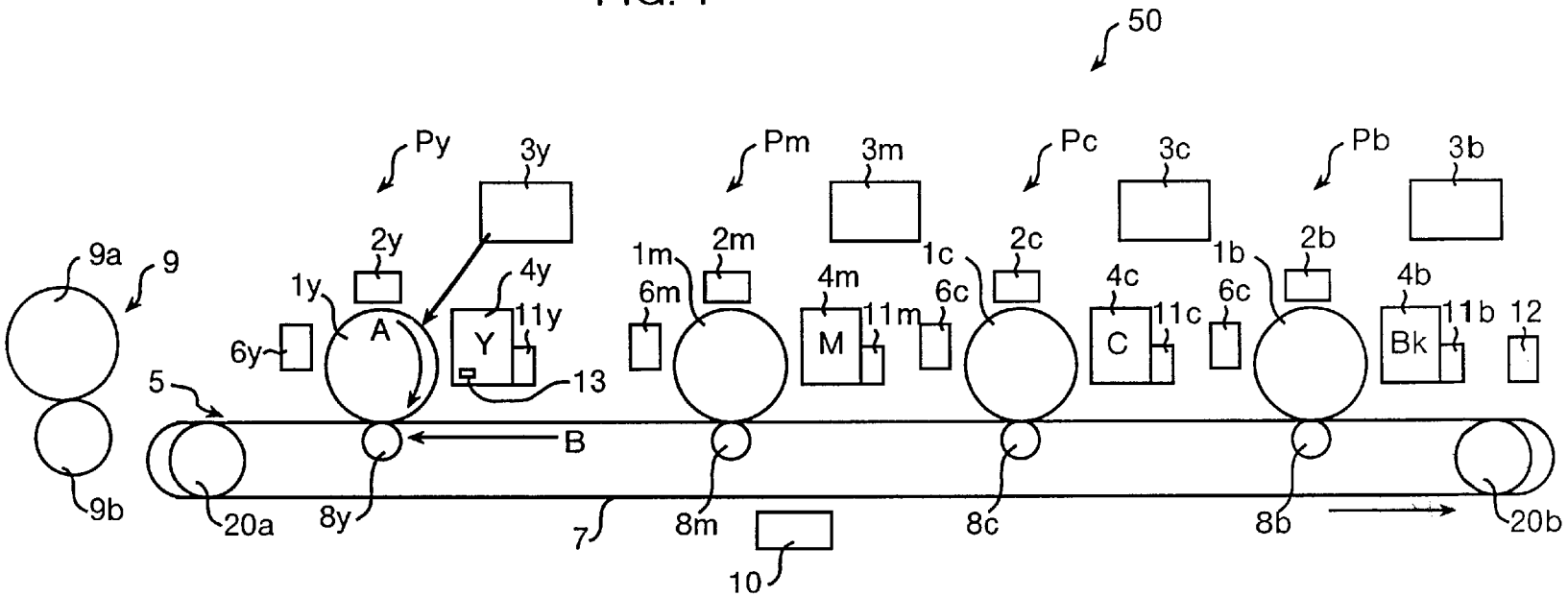
FIG. 1 is a schematic cross-sectional view showing the construction of an image forming apparatus of the present invention.
Figure 2:
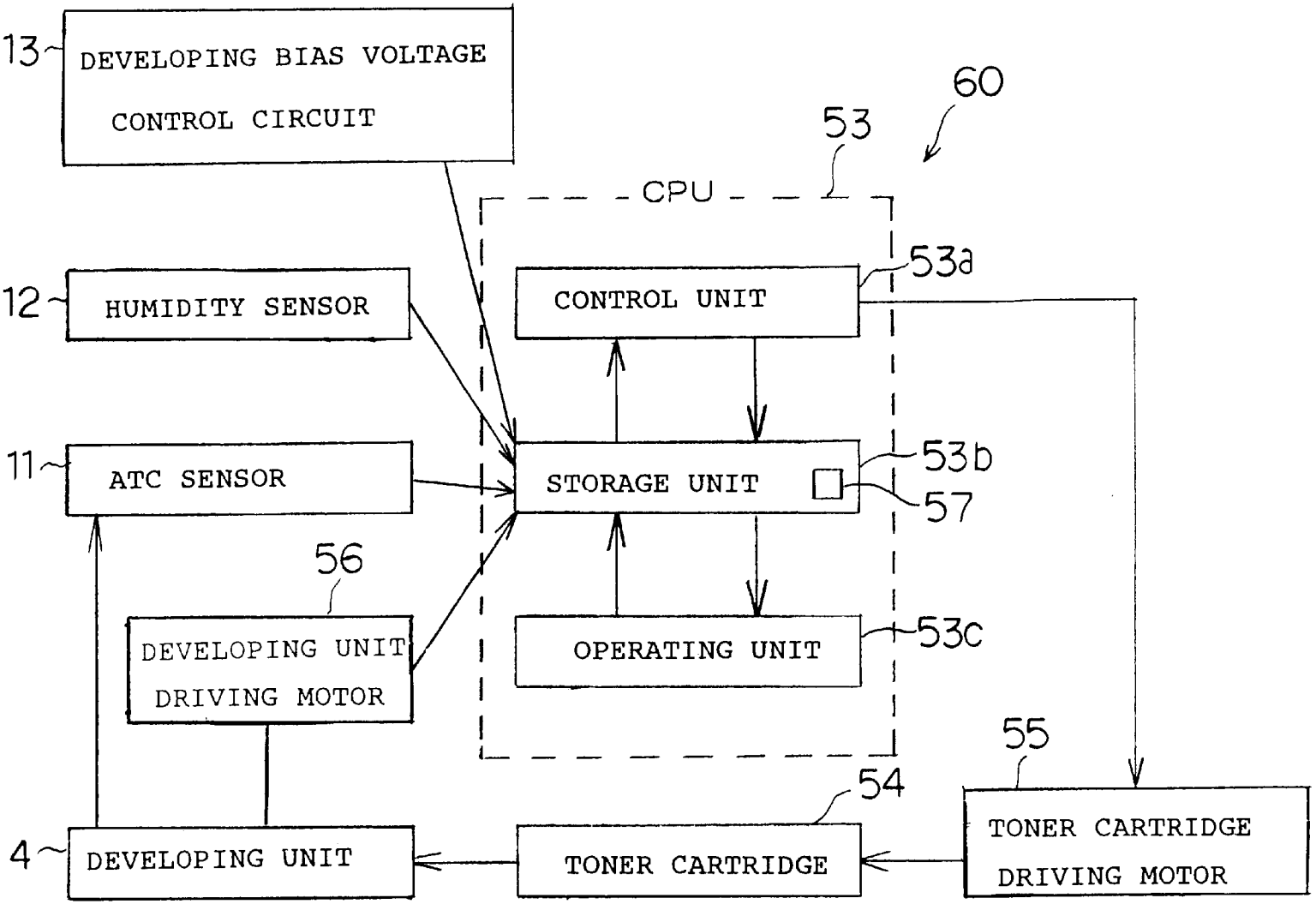
FIG. 2 is a block diagram showing a circuit portion for correcting the toner specific concentration in accordance with the humidity variation in the image forming apparatus of FIG. 1.

The overall construction of an image forming apparatus (electrophotographic apparatus) according to an embodiment of the present invention with reference to FIGS. 1 and 2.

As shown in FIG. 1, in order to form an image of plural colors (yellow:Y, magenta: M, cyan: C, black: Bk), an image forming apparatus 50 is equipped with image forming process units Py, Pm, Pc, Pb for respective colors Y, M, C, Bk which are disposed linearly from the left side of FIG. 1, respectively. These image forming units have substantially the same construction.

Accordingly, in order to avoid duplicative description, these image forming process units will be collectively described while subscripts (y,m,c,bk) are omitted in the description on common parts. Further, it is needless to say that the present invention is applicable to a monochromatic image forming apparatus having a single image forming process unit.

In FIG. 1, the image forming process unit P is equipped with a photosensitive drum 1 which is freely rotatably supported, and the photosensitive drum 1 is rotated in the direction indicated by an arrow A in the image forming process unit Py by a driving device. Around the photosensitive drum 1 are disposed, in the following order, an electrifying unit 2 for uniformly electrifying the surface of the photosensitive drum 1, an exposure unit 3 for exposing the surface of the photosensitive drum 1 to light to form a latent image, a developing unit 4 having a developing agent tank for developing the latent image and forming a toner image, a transfer unit 5 for transferring the toner image to a transfer medium, and a cleaning device 6 for cleaning toner remaining on the surface of the photosensitive drum 1.

An ATC sensor 11 serving as a toner specific concentration detecting unit is disposed in the developing agent tank (not shown) of the developing unit 4. The developing unit 4 has a developing roller (not shown), a toner cartridge 54, a toner cartridge driving motor 55 for supplementing toner from the toner cartridge 54 through a screw conveyor (not shown) into the developing agent tank, a developing unit driving motor 56 for stirring developing agent containing toner in the developing agent tank and a developing bias voltage control circuit 13 for applying a bias voltage to the developing roller (see FIG. 2).

The transfer unit 5 is disposed below the image forming process unit P. The transfer device 5 has a endless transfer belt 7 which is rotated while being laid under tension between a driving side pulley 20*a* and a driven side pulley 20*b* linked to each other by a driving unit (not shown), and it is rotated in the direction indicated by an arrow B. The transfer belt 7 is formed of denatured polyimide or the like, and the transfer medium (recording medium) is moved together with the rotation of the transfer belt 7 while it is electrostatically held on the transfer belt 7.

A humidity sensor 12 is further disposed in the image forming process unit P, and it is disposed at a proper place in the neighborhood of the developing unit 4 in the image forming apparatus 50 so as to be avoidable from contamination of floated toner.

This embodiment adopts a system of disposing the plural image forming process units P linearly and transferring a toner image onto a single transfer belt. However, the present invention is not limited to such a multi-color image forming apparatus as described above, and it may be applied to a multi-color image forming apparatus (or monochromatic image forming apparatus) in which a cylindrical photosensitive drum and a transfer drum are used.

A transfer electrifying unit 8 is disposed inside the endless transfer belt 7 so as to face the photosensitive drum 1, and transfers a visual image (toner image) formed on the photosensitive drum 1 onto the transfer medium. A cleaning member for the transfer belt 7 and a discharging member for removing undesired charges trapped on the belt (these members are not shown) are disposed inside and outside the endless transfer belt 7.

When visual images of respective colors are successively transferred onto the transfer medium held on the transfer belt 7 in the order of the image forming process units Pb, Pc, Pm, Py through the rotation of the transfer belt 7, the transfer medium is passed through a site at which a heat roller 9*a* and a press roller 9*b* constituting a fixing unit 9 face each other and come in contact with each other, whereby the visual images are fixed on the transfer medium with heat and pressure and become permanent visual images.

The image density detection sensor 10 is provided at a proper position below the transfer belt loop so as to face the transfer belt 7, and it detects the density of a visual image portion (for example, a reference visual image or test patch) formed on the transfer belt 7 by the developing unit 4.

Here, the image density detection sensor 10 is a reflection or transmission type optical sensor comprising a photodetecting element and a light emitting element. It exposes a toner image to light from the light emitting element and also detects reflection light (transmission light) to generate the output voltage or output current corresponding to the photodetected light amount. The image forming process unit P carries out a suitable correction on the basis of the detection value of the image density detection sensor 10 so that the image density is proper. Any detection means other than the above optical sensor may be used as the image density detecting unit, or plural sensors 10 may be separately disposed in connection with the plural image forming process units P or the overall or a part of toner.

FIG. 2 is a circuit block diagram showing the toner specific concentration control of the image forming apparatus 50.

As shown in FIG. 2, the image forming apparatus 50 includes a controller 60 having CPU 53 which is connected to each input/output portion of the ATC sensor 11, the toner cartridge driving motor 55, the developing unit driving motor 56, the developing bias voltage control circuit 13 and other driving units. CPU 53 has a control unit 53*a*, a storage unit 53*b* and an operating unit 53*c*. The storage unit 53*b* has a stock time/exchange time humidity storage unit 57 for storing the humidity at the time when developing agent is stocked (hereinafter referred to as "humidity at the developing agent stock time") or when developing agent is exchanged by new one (hereinafter referred to as "humidity at the developing agent exchange time") as reference humidity.

The controller 60 has ROM, RAM, a timer, etc. (not shown), and controls each input/output portion of the toner supply unit, the toner specific concentration detecting unit, the humidity detecting unit, the storage unit, the toner specific concentration correcting unit, the voltage applying unit, the image density detecting unit and the image density control unit as described later.

In the above-described embodiment, in the image density control unit, the image density detection sensor 10 detects the density of a reference toner patch which is formed on the transfer belt 7 or the transfer medium which is carried on the transfer belt 7, and the toner patch density detection value is input to CPU 53, for example. In accordance with the toner patch density, a predetermined operation is carried out by a lookup table stored in the storage unit 53*b* or by the operating unit 53*c* to determine a proper developing bias output value, and the signal corresponding to the developing bias output value is output to the developing bias voltage control circuit 13 of the developing unit 4 (not shown) to properly vary the developing bias value, whereby the correction of the image density can be executed.

The target to be varied through the image density correction is not limited to the developing bias having a direct and close relationship with the toner specific concentration, but it may extend to the exposure amount of the exposing unit 3, the electrification output of the electrifying unit 2, the transfer output of the transfer electrifying unit 8, etc.

Furthermore, the humidity sensor 12 serving as the humidity detection unit for detecting the surrounding humidity is disposed in the neighborhood of the image forming process units Pb, Pc, Pm, Py, the transfer belt 7 or the transfer electrifying unit 8, and it detects the humidity in the neighborhood of the image forming process unit P. In this embodiment, the single humidity sensor 12 is provided in the image forming process unit P. However, the humidity sensor 12 may be provided at each of plural positions of the plural image forming process units P, or may be provided in the neighborhood of the developing tank of the developing unit 4 or inside the developing tank. It is best that the humidity itself is detected, however, humidity information associated with humidity (the voltage, current or the like which corresponds to the humidity) may be detected.

When plural humidity sensors 12 are disposed as described above, the control of the humidity sensor 12 is relatively complicated. However, the humidity can be surely detected for every image forming process unit P, for example, the difference in humidity dependence among the respective color toner materials can be compensated and the difference in humidity distribution in the units can be also compensated, and thus higher precision control can be performed.

On the other hand,, when a single humidity sensor 12 is used, the control is relatively easily performed, the manufacturing cost of the sensor and the sensor circuit can be reduced and also the disposing space of parts can be reduced. However, when a humidity distribution exists in the apparatus 50 or the correlation between the humidity and the ATC sensor output is varied for every toner, the control precision is reduced to a level lower than in the case where the plural humidity sensors 12 are provided. Therefore, in order to keep the precision, it is preferable to provide a humidity sensor 12 having a small sensor output dispersion for every image forming process unit P.

The toner specific concentration of the developing agent stocked in the developing unit 4 is detected by a magnetic type ATC sensor 11. CPU 53 controls the toner supplement from the toner cartridge 54 to the developing unit 4 through the driving of the toner cartridge driving motor 55 in accordance with the detection information of the ATC sensor 11.

The copy amount (frequency) and the stirring time (stirring rotating frequency) of the developing agent from the initial state such as the developing agent stocking time or the developing agent exchanging time are detected on the basis of the rotational (stirring) time or rotational frequency of the developing unit driving motor 56, stored in the storage unit 53*b* of the CPU 53, and the humidity information detected by the humidity sensor 12 is read in, whereby the operating unit 53*c* calculates the optimum ATC output reference value and the control unit 53*a* controls the ATC output reference value at the humidity variation time in accordance with the detection information. In order to detect the rotational frequency, the accumulation value of the driving signal interval of the motor 56, the accumulation value of a built-in timer for the driving time or the like may be used.

Next, the developing agent of the developing unit 4 will be described.

The image forming apparatus 50 of the present invention uses two-component developing agent comprising toner and carriers. The two-component developing agent has a humidity-dependent characteristic, and thus if the toner specific concentration is not corrected in accordance with the humidity variation, the toner specific concentration is increased as the humidity is increased. Conversely, the toner specific concentration is reduced as the humidity is lowered.

This phenomenon occurs because the ATC sensor 11 detects the magnetic flux density to control the toner specific concentration. For example, when the humidity is increased, the charging amount of the developing agent is lowered, and thus the developing agent is kept tighter as a whole. Therefore, the ATC sensor 11 judges that the density of the carriers is high, that is, the toner specific concentration is low, so that the toner is supplemented.

On the other hand, when the humidity is reduced, the charging amount of the developing agent is increased, and the developing agent is kept swollen. Therefore, the ATC sensor 11 judges that the carrier density is low, that is, the toner specific concentration is high, so that the toner supplement is stopped.

Figure 8:
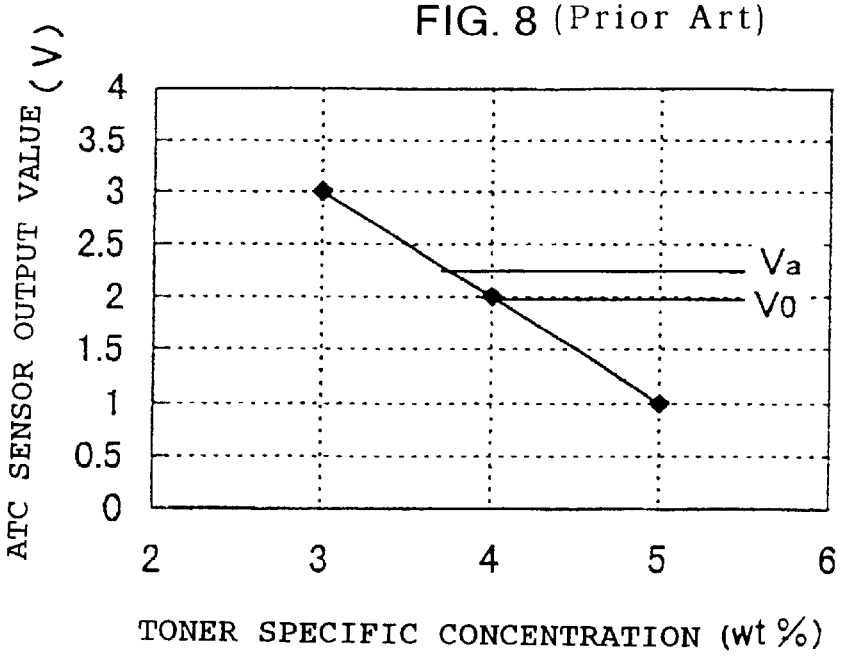
FIG. 8 (Prior Art)
FIG. 8 is a graph showing the relationship between the toner specific concentration and the ATC sensor output value to explain the toner specific concentration correction in the conventional image forming apparatus.
Figure 9:
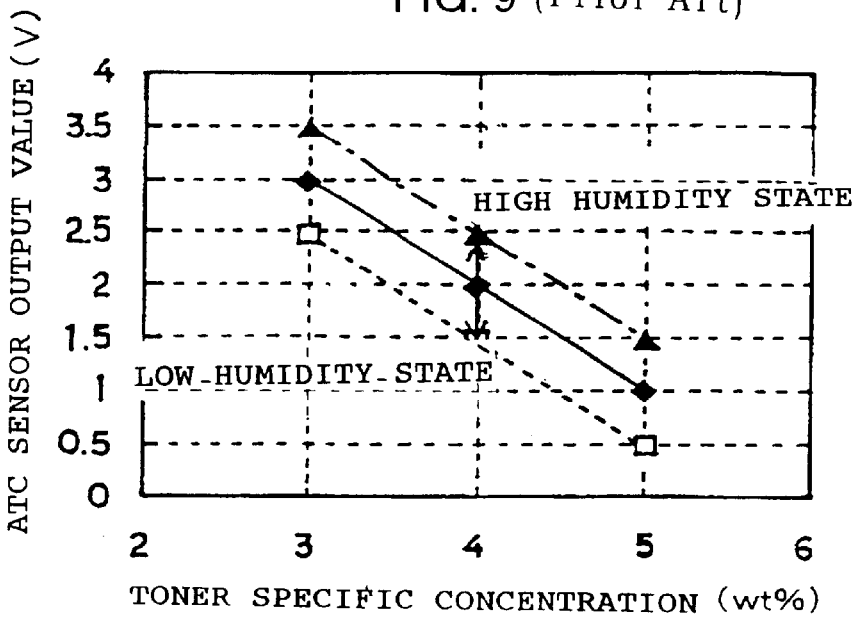
FIG. 9 (Prior Art)
FIG. 9 is a graph showing the relationship between the toner specific concentration and the ATC sensor output value to explain the toner specific concentration correction in another conventional image forming apparatus.

That is, as described above, the characteristic curve of FIG. 8 which indicates the ATC sensor output is varied to such a characteristic curve as shown in FIG. 9. No stable image can be obtained unless this phenomenon is corrected.

Next, the correction of the toner specific concentration in the above-described image forming apparatus 50 when humidity is varied will be described on the basis of the following embodiments 1 to 4.

[Embodiment 1]

In the embodiment 1, when the initial toner specific concentration is detected by the ATC sensor 11 at the developing agent stocking time or the developing agent exchange time and stored in the storage unit 53*b*, the humidity at that time is detected by the humidity sensor 12 and the output voltage of the humidity sensor 12 is stored as reference humidity into a stock time/exchange time humidity storage unit 57, and the correction of the toner specific concentration is performed on the basis of the reference humidity by the control unit 53*a* of CPU 53 when the output voltage of the humidity sensor 12 is varied by ±0.2V, ±0.4V, ±0.6V or more, respectively.

Figure 3:
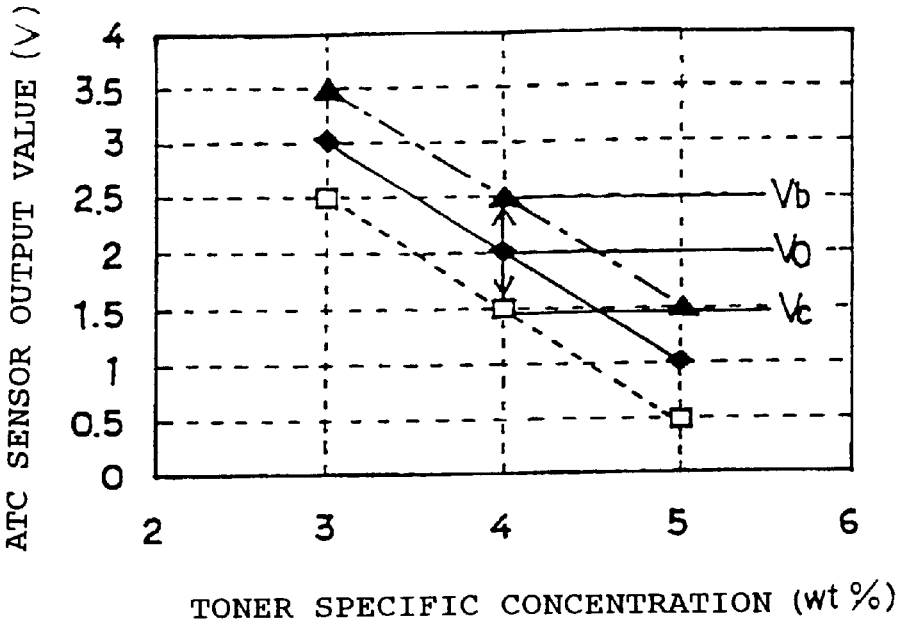
FIG. 3 is a graph showing the output variation of an ATC sensor with the variation of the toner specific concentration under a high humidity state and under a low humidity state of a developing unit of the image forming apparatus of FIG. 1.

For example, if the output voltage of the humidity sensor 12 when the initial toner specific concentration is stored is equal to 0.5V, the toner specific concentration is corrected so that the reference value V0 is shifted to Vb as shown in FIG. 3 when the output voltage of the humidity sensor 12 is varied by 0.7V to 0.89V. If the output voltage of the humidity sensor 12 is 0.9V or more, the toner specific concentration is corrected so that the reference value V0 is shifted to any value of Vb or more.

If the output value of the humidity sensor 12 is varied by 0.11 to 0.3V, the toner specific concentration is corrected so that the reference value V0 is shifted to Vc. If the output value of the humidity sensor 12 is 0.1V or less, the toner specific concentration is corrected so that the reference value V0 is shifted to any value of Vc or less.

Figure 10:
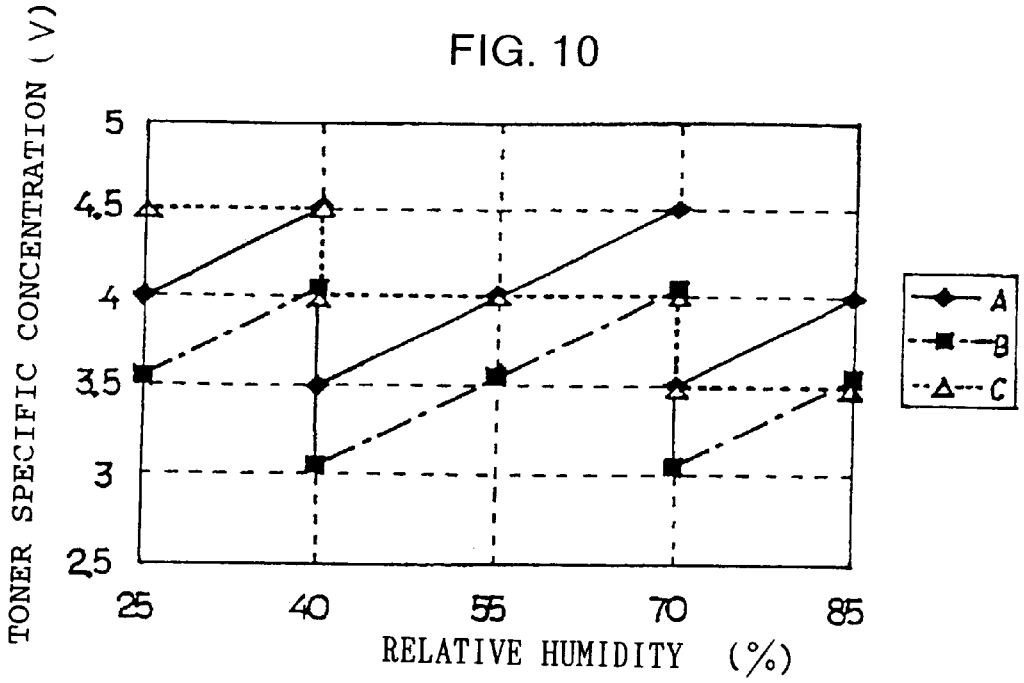
FIG. 10 is a graph showing the correction of the toner specific concentration under the high humidity state and under the low humidity state of the developing unit of the image forming apparatus of each of the present invention and the prior art.

Upon describing this situation with reference to FIG. 10, the variation of the toner specific concentration is not shifted upwardly or downwardly, but shifted in the right-and-left direction in accordance with the humidity at the developing agent stocking time or the developing agent exchange time.

As described above, the humidity variation range in which the toner specific concentration is corrected is determined by using as the reference humidity the output value of the humidity sensor 12 at the developing agent stocking time or the developing agent exchange time, whereby the toner specific concentration is corrected only when the humidity is actually varied from the initial state. Therefore, the toner specific concentration is prevented from being greatly deviated from the reference value of the toner specific concentration.

Further, in the vicinity of the boundary between the preset ranges in which the correction is carried out, for example, when the output value of the humidity sensor 12 is in the vicinity of 0.1V, 0.3V, 0.7V, 0.9V in the above embodiment, no correction is carried out on the toner specific concentration unless the difference from the output value of the humidity sensor when the previous toner specific concentration correction was carried out is above a predetermined value or more, for example, ±0.1V.

That is, when the output value of the humidity sensor 12 is varied from 0.68V to 0.72V, no correction is carried out on the toner specific concentration. Accordingly, the disadvantage that the correction is carried out or not carried out due to a slight humidity variation can be overcome, and the correction of the toner specific concentration is executed only when the humidity varies actually, so that stable toner specific concentration can be achieved at all times.

In the image forming apparatus 50, a desired toner pattern is formed on the photosensitive drum 1 while the developing bias value is varied by the developing bias voltage control circuit 13 in order to keep the image density constant, the density of the toner pattern is detected by the image density detection sensor 10, the detection value and the toner pattern density reference value are compared with each other, and the developing bias value is controlled on the basis of the comparison result by the image density control means, thereby performing high density correction.

In this case, in the case where the image forming apparatus is designed so that the judgment as to whether the correction of the toner specific concentration is necessary or not is made by using the developing bias value for the high density correction, for example when the surrounding atmospheric state is varied to the high humidity state, the developing bias value is expected to be varied in the plus direction (in the direction that reduces the image density). However, if the developing bias value is varied in the minus direction (in the direction that increases the image density), it suggests that it is obstructed to increase the image density due to some cause. Accordingly, if the toner specific concentration is corrected to be reduced, it falls into a worse state in which is more difficult to increase the image density.

In order to solve this disadvantage, according to the image forming apparatus 50, the toner specific concentration is corrected only when the developing bias value is varied in the plus/minus direction by a predetermined value (±10V) or more if the atmosphere is varied to the high humidity state/low humidity state.

With the above construction, even when the humidity is varied, the toner specific concentration can be kept stable and a stable image can be achieved at all times.

Further, in the case where the correction of the toner specific concentration as described above is carried out, the toner specific concentration is corrected only when the average of the variation amounts of the developing bias values in the developing units 4 for the respective colors of Y, M, C, Bk is varied by a predetermined value (±10V) or more. Therefore, the toner specific concentration can be accurately corrected only when the correction of the toner specific concentration is actually needed. Further, the toner specific concentration can be carried out for the developing units 4 of all the colors.

[Embodiment 2]

Figure 11:
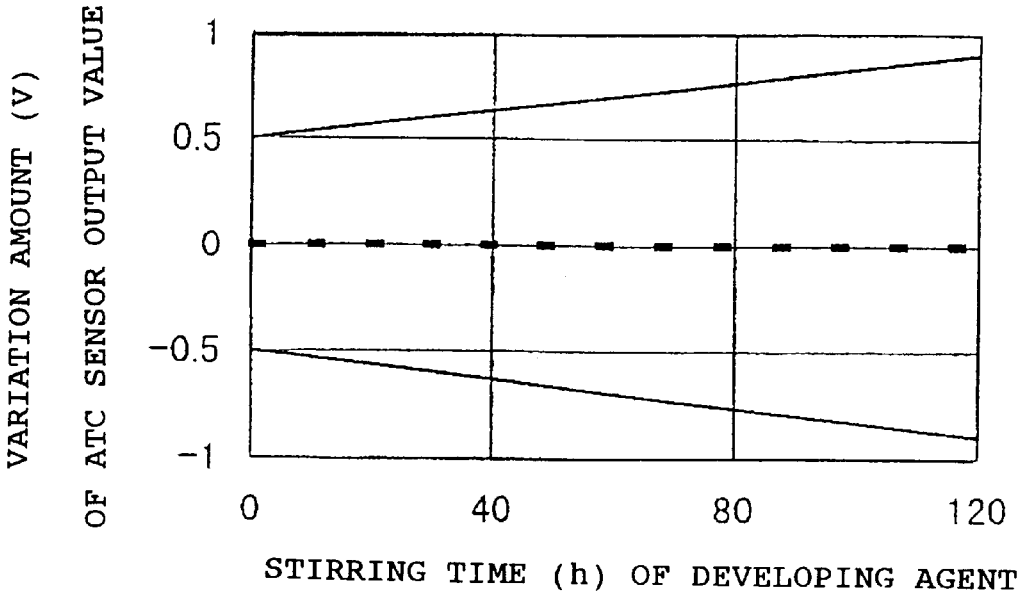
FIG. 11 (Prior Art)
FIG. 11 is a graph showing the variation amount of the ATC sensor output value for the stirring time of the developing agent in the conventional image forming apparatus.
Figure 12:
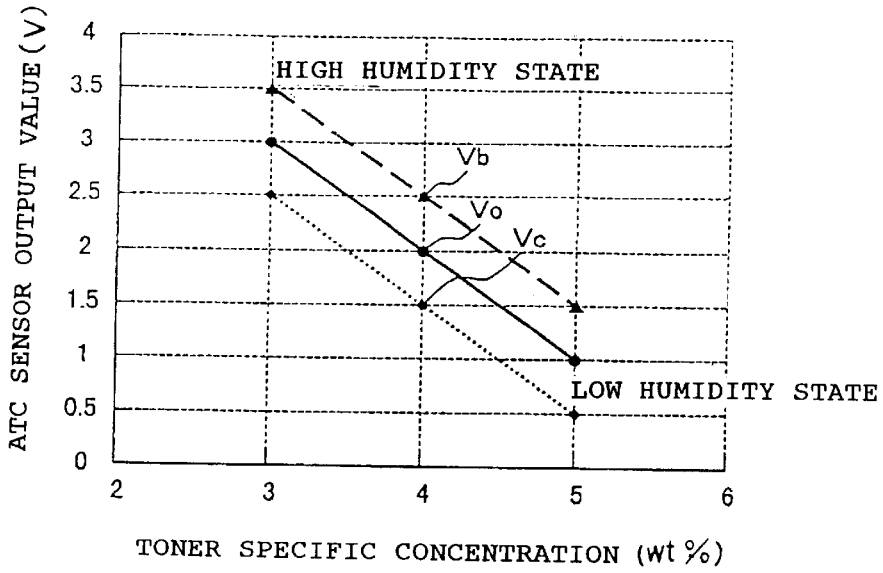
FIG. 12 (Prior Art)
FIG. 12 is a graph showing the relationship between the toner specific concentration and the ATC sensor output value under the high humidity state and under the low humidity state of the developing apparatus of the conventional image forming apparatus.
Figure 14:
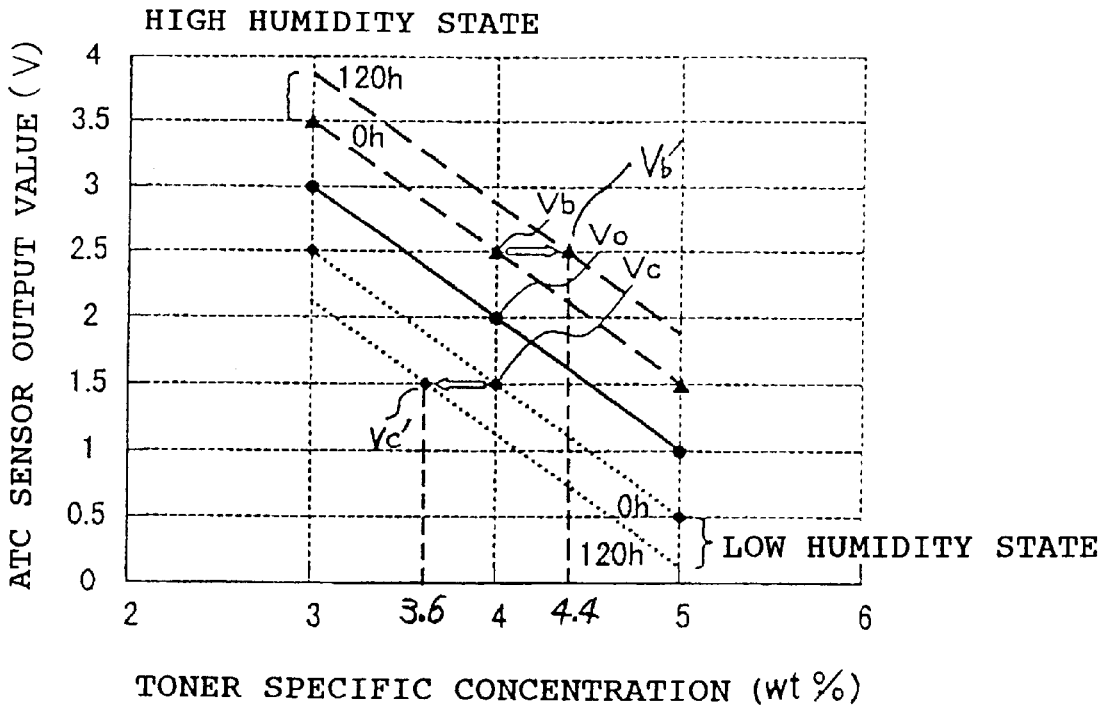
FIG. 14 is a graph showing the relationship among the toner specific concentration, the ATC sensor output value, the humidity atmosphere and the reference value correction.

As described with reference to FIGS. 9, 11 and 14, in the conventional image forming apparatus, when the correction amount for humidity is proper for the developing agent just after exchange, the correction amount runs short for the developing agent progressing in deterioration because of increase of the copy frequency. At this time, if the atmosphere is shifted to the high humidity state, the toner specific concentration increases. If the atmosphere is shifted to the low humidity state, the toner specific concentration is lowered.

According to the embodiment of the image forming apparatus of the present invention, the correction amount of the output reference value of the ATC sensor for the humidity variation is varied in accordance with the stirring time of the developing agent to control the toner specific concentration, thereby solving the above problem of the conventional image forming apparatus.

Figure 4:
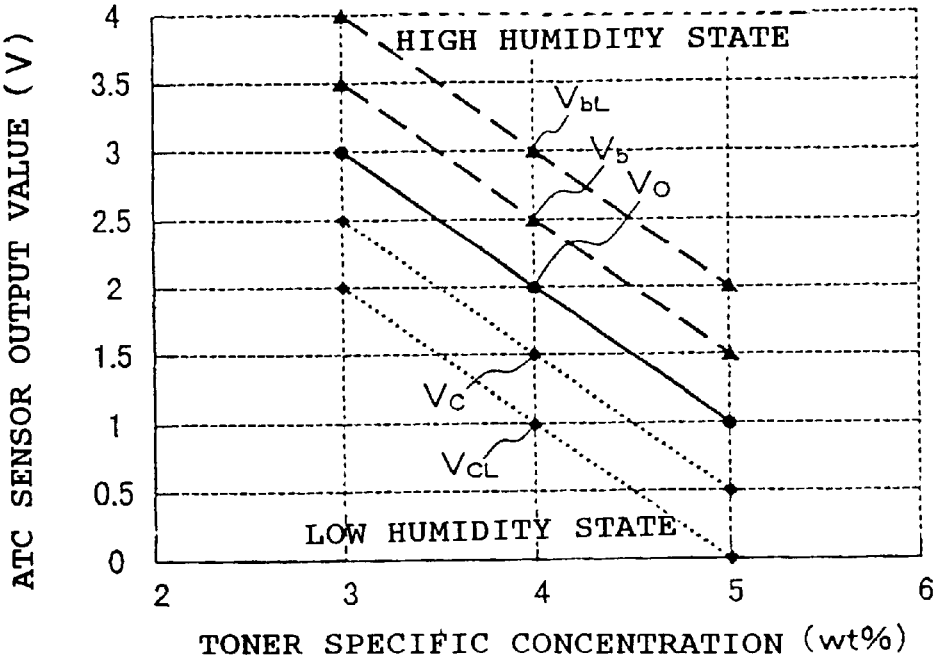
FIG. 4 is a graph showing the relationship among the toner specific concentration, the ATC sensor output value, the humidity atmosphere and the reference value correction in an embodiment of the present invention.

For example, when a humidity atmosphere in which the output value of the humidity sensor 12 is equal to 0.41 to 0.59V is varied to a humidity atmosphere in which the output value of the humidity sensor 12 is equal to 0.6 to 0.89V, the output reference value V0 of the ATC sensor is shifted to Vb in the case of developing agent at the initial stage, while the output reference value V0 of the ATC sensor is shifted to Vbl in the case of developing agent which has been stirred for 120 h or more (i.e., the stirring time of 120 h or more) as shown in FIG. 4.

When the output value of the humidity sensor 12 is varied to 0.9V or more, in the case of the developing agent under the initial state just after exchange, the output reference value V0 of the ATC sensor is shifted to a predetermined value of Vb or more, and in the case of the developing agent which has been stirred for 120 h or more, the output reference value V0 of the ATC sensor is shifted to a predetermined value of VbL or moe.

When the output value of the humidity sensor 12 is varied to 0.2 to 0.3V, in the case of the developing agent under the initial state, the output reference value V0 of the ATC sensor is shifted to Vc, and in the case of the developing agent which has been stirred for 120 h or more, the output reference value V0 of the ATC sensor is shifted to VcL.

When the output value of the humidity sensor 12 is varied to 0.19V or less, in the case of the developing agent under the initial state just after the exchange of developing agent, the output reference value V0 of the ATC sensor is shifted to a predetermined value of Vc or less, and in the case of the developing agent whose stirring time is equal to 120 h or more, the output reference value V0 of the ATC sensor is shifted to a predetermined value of VcL or less.

Figure 13:
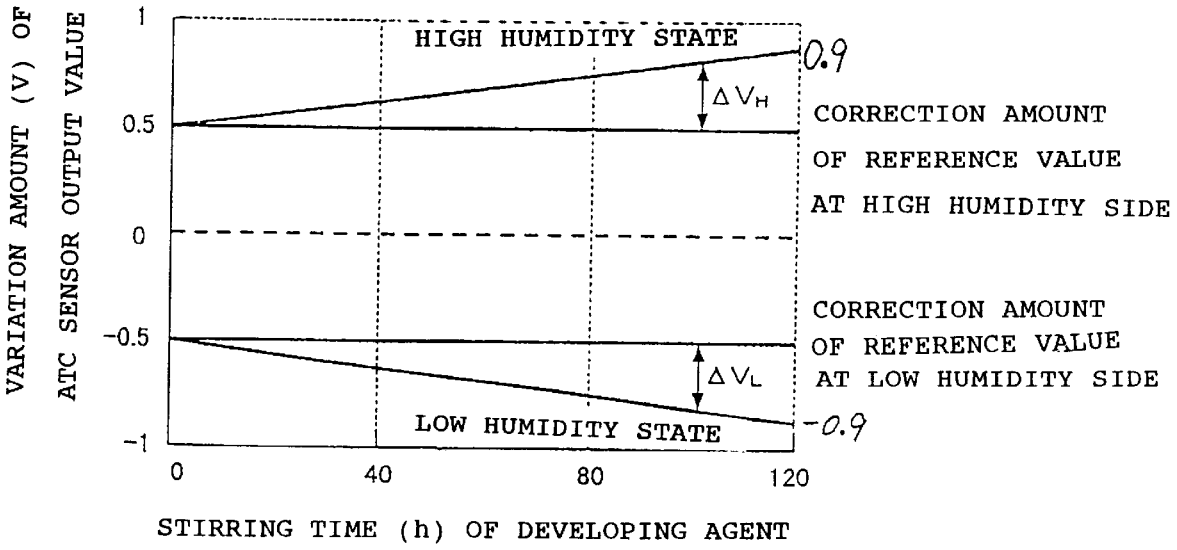
FIG. 13 is a graph showing the relationship among the developing agent stirring time, the variation amount of the ATC sensor output value, the humidity atmosphere and the reference value correction in the prior art and the present invention.

Adding a supplemental description with reference to FIG. 13, by adding the correction amount of the reference value in the developing agent under the initial state, with a variation amount ΔVH at the high humidity state and a variation amount ΔVL at the low humidity state which vary stepwise in accordance with the stirring time of the developing agent, the toner specific concentration can be stabilized irrespective of the stirring time of the developing agent at all times even when the humidity is varied.

FIG. 13 shows a case where ΔVH and ΔVL are continuously varied in accordance with the stirring time of the developing agent, and this embodiment is more effectively used in such a case where the deterioration of the developing agent which induces variation of the electrification amount or the like is continuously varied in accordance with the stirring time.

In this case, the rotational state of the developing unit driving motor 56 or the like is minutely monitored, and the optimal correction amount is calculated in accordance with the stirring time at that time by the operating unit 53*c*, or if necessary, a lookup table is provided in the storage unit 53*b* and the correction amount corresponding to the stirring time is read out from the lookup table to be controlled.

In this case, however, it is necessary to calculate or read out the correction amount, and a control circuit, control software, etc. are more complicated. Therefore, if the correction amount is varied in two or more stages (for example, the correction amount is stepwise varied in FIG. 13), the control circuit and the control software can be more simplified although the control precision is slightly lowered.

Selection of any one of the above two methods may be synthetically determined in consideration of the price zone of products and the relationship between the stirring time and the deterioration of the developing agent.

[Embodiment 3]

In this embodiment, when the correction of the toner specific concentration based on the humidity variation is carried out, without storing a predetermined humidity range, the toner specific concentration under the initial state is stored and also the humidity at that time is stored through the humidity sensor 12 into the storage unit 53*b*. When the output of the humidity sensor is varied from the value thus stored (reference value) by a predetermined width (for example, ±0.2V, ±0.4V, ±0.6V) or more, the correction of the toner specific concentration is carried out.

Figure 5:
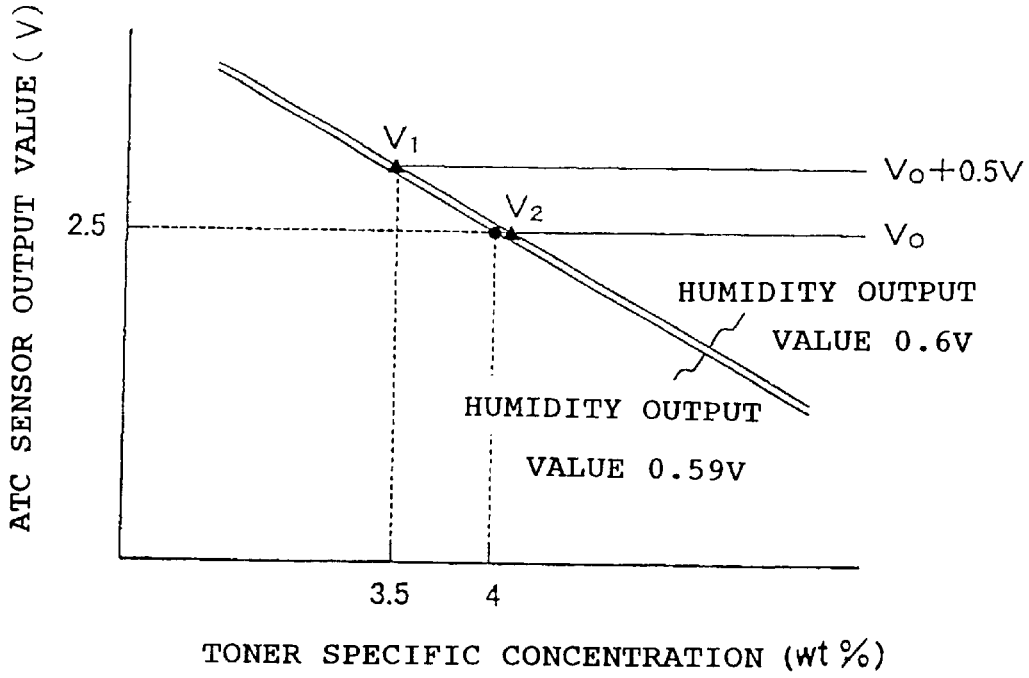
FIG. 5 is a graph showing the relationship among the toner specific concentration, the ATC sensor output value, the humidity atmosphere and the reference value correction in another embodiment of the present invention.

For example, as shown in FIG. 5, when the reference humidity at the storing time of the initial toner specific concentration is equal to 0.59V (the output value of the humidity sensor) on the condition that the correction of the ATC output correction value is carried out when the humidity sensor output value is in a predetermined humidity range or more (for example, 0.6V or more), the ATC output reference value is shifted from V0 to V0+0.5V at the humidity output value of 0.6V although the ATC output characteristic curve with respect to the toner specific concentration is hardly varied between the humidity output values 0.59V and 0.6V, so that the toner specific concentration is varied from 4% to 3.5%, for example.

In the image forming apparatus 50, the predetermined humidity range in which the toner specific concentration is corrected is not set, but the toner specific concentration is corrected in the humidity range determined on the basis of the reference humidity output value, whereby the toner specific concentration can be controlled on the basis of the ATC sensor output reference value V0 without carrying out the toner specific concentration correction, that is, the toner specific concentration can be controlled without varying the toner specific concentration.

Figure 6:
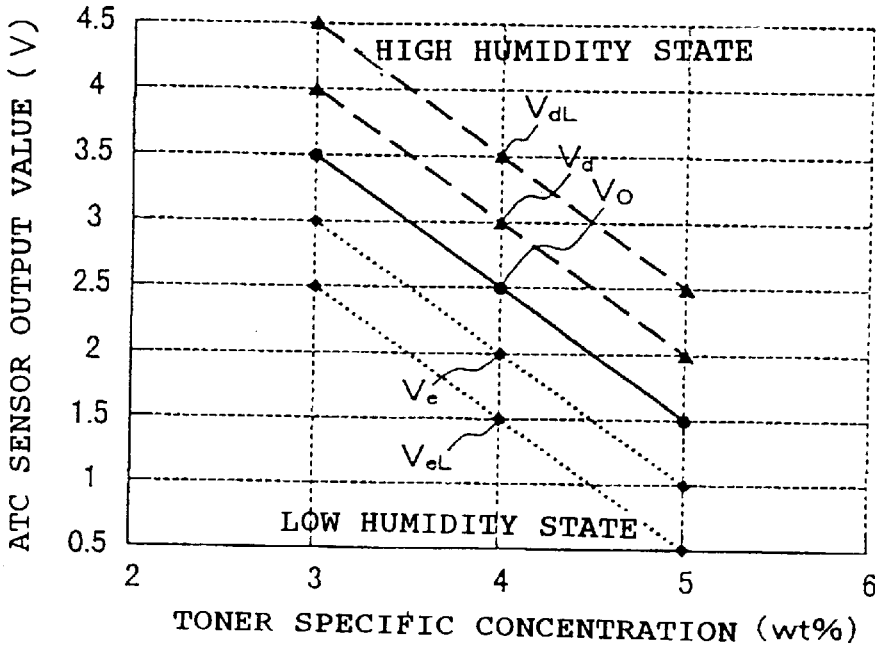
FIG. 6 is a graph showing the relationship among the toner specific concentration, the ATC sensor output value, the humidity atmosphere and the reference value correction in another embodiment of the present invention.
Figure 7:
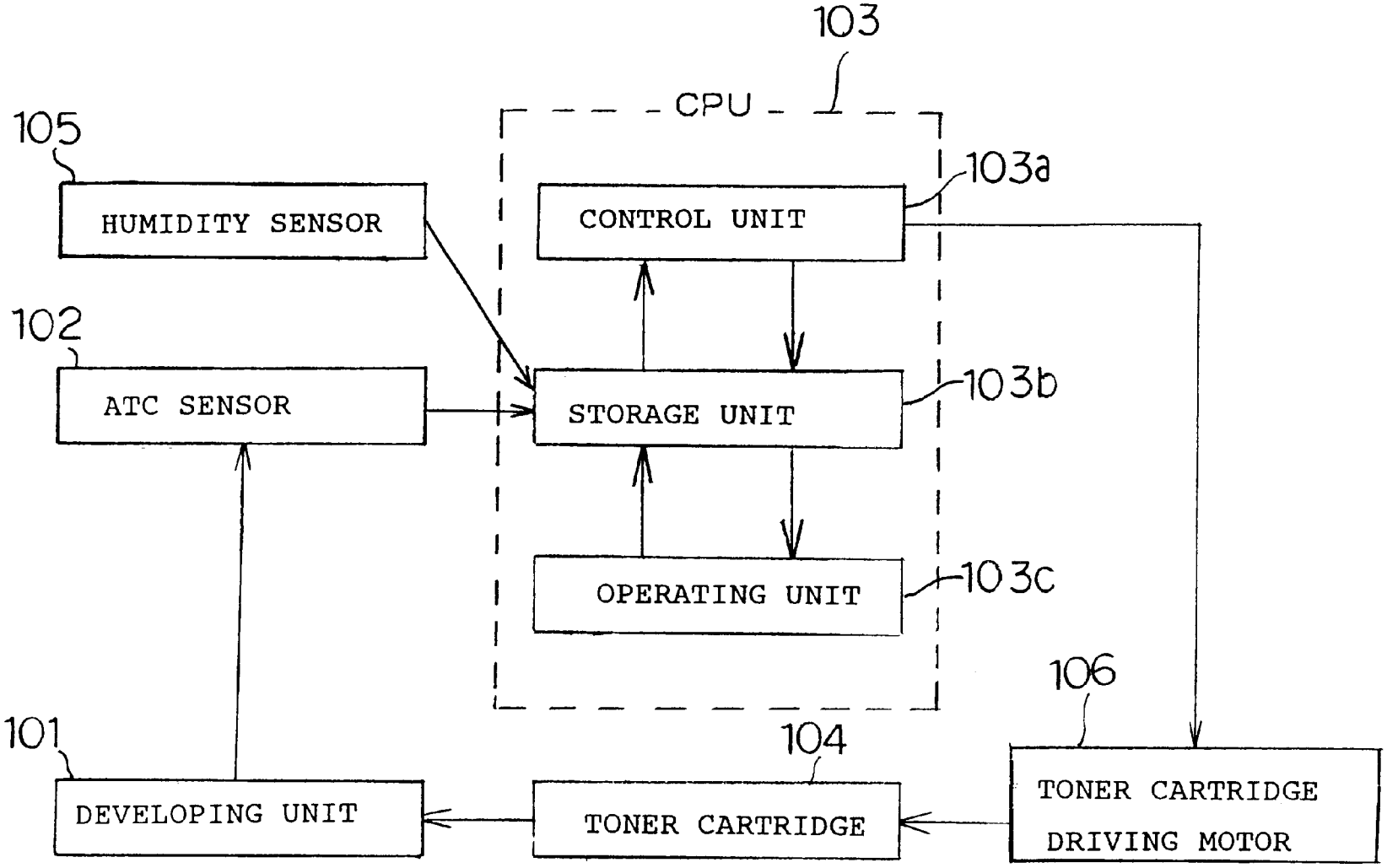
FIG. 7 (Prior Art)
FIG. 7 is a block diagram showing a circuit portion for correcting the toner specific concentration of a conventional image forming apparatus.

At this time, when the humidity sensor output value is varied to 0.79 to 0.98V, the output reference value of the ATC sensor is shifted from V0 to Vd in the case of the developing agent under the initial state just after the exchange, and the output reference value of the ATC sensor is shifted from V0 to VdL in the case of the developing agent having the stirring time of 120 h or more as shown in FIG. 6.

When the output value of the humidity sensor 12 is varied to 0.99V or more, the output reference value V0 of the ATC sensor is shifted to a predetermined value of Vd or more in the case of the developing agent under the initial state just after the exchange, and it is shifted to any value of VdL or more in the case of the developing agent having the stirring time of 120 h or more.

When the output value of the humidity sensor is varied to 0.20 to 0.39V, the output reference value V0 of the ATC sensor is shifted to Ve in the case of the developing agent under the initial state just after the exchange of the developing agent, and it is shifted to VeL in the case of the developing agent having the stirring time of 120 h or more.

When the output value of the humidity sensor 12 is varied to 0.19V or less, the output reference value V0 of the ATC sensor is shifted to a predetermined value of Ve or less in the case of the developing agent under the initial state just after the exchange, and it is shifted to any value of VeL or less in the case of the developing agent having the stirring time of 120 h or more.

Adding a supplemental description with reference to FIG. 13, by adding the correction amount of the reference value for the developing agent under the initial state just after the exchange, with the variation amount ΔVH and the variation amount ΔVL at the high humidity state which at the low humidity state vary stepwise in accordance with the stirring time of the developing agent, the correction of the toner specific concentration based on the humidity variation can be carried out in conformity with the actual humidity variation of the developing agent, and the toner specific concentration can be stabilized with respect to the humidity variation irrespective of the stirring time of the developing agent. Like the embodiment 2, the correction amount may be stepwise varied.

[Embodiment 4]

In this embodiment, in the vicinity of the boundary between the preset ranges in which the correction is carried out, that is, when the output value of the humidity sensor 12 is in the vicinity of 0.19V, 0.79V, 0.99V in the above embodiment 3 described with reference to FIG. 6, no correction is carried out on the toner specific concentration unless the difference from the output value of the humidity sensor when the previous toner specific concentration correction was carried out is ±0.1V or more.

For example, when the output value of the humidity sensor 12 is varied from 0.77V to 0.82V, no correction is carried out on the toner specific concentration. Accordingly, the disadvantage that the correction is carried out or not carried out due to a slight humidity variation can be overcome, and the toner specific concentration is executed only when the humidity is actually varied, so that the stable toner specific concentration can be achieved at all times. Further, even when a humidity sensor 12 which is relatively low in precision and inexpensive is used for the image forming apparatus 50, it can support such a case that the humidity information to be detected is liable to vary.

[Embodiment 5]

In this embodiment, on the basis of the developing bias value for correcting the density, it is judged whether the correction of the toner specific concentration should be carried out or not.

In the image forming apparatus 50 of this embodiment, as shown in FIG. 1, the image density detection sensor 10 detects the density of the reference toner patch formed on the transfer belt 7 or the transfer medium carried on the transfer belt 7 and inputs the toner patch density detection value to, for example CPU 53. The toner patch density detection value thus input is subjected to a predetermined operation in accordance with the toner patch density, on the basis of a lookup table stored in the storage unit 53*b* or by the operating unit 53*c* to gain a proper developing bias output value, the signal corresponding to the developing bias output value thus gained is output to the developing bias voltage control circuit 13 (FIG. 2) of the developing unit 4, and the developing bias value is properly altered on the basis of the signal, whereby the correction of the image density can be executed.

However, when the surrounding atmosphere is varied to the high humidity state, the proper developing bias value is expected to be varied in the plus direction (in the direction that reduces the image density). When the developing bias value is varied in the minus direction (in the direction that increases the image density), it is suggested that the image density is not increased due to some cause, and if the toner specific concentration is directed to be reduced, it falls into a worse state in which it is more difficult to increase the image density.

In order to avoid this disadvantage, the toner specific concentration is corrected only on the condition that the developing bias value is varied in the plus direction when the surrounding atmosphere is varied to the high humidity state and only on the condition that the developing bias value is varied by a predetermined amount, for example, 10V or more when the surrounding atmosphere is varied to the low humidity state.

Accordingly, the correction of the toner specific concentration based on the humidity variation can be carried out in conformity with the actual humidity variation of the developing agent, and the toner specific concentration can be kept stable at all times with respect to the humidity variation irrespective of the stirring time of the developing agent, so that a stable image can be obtained.

The image forming apparatus 50 according to the present invention shown in FIG. 1 has plural image forming process units P for respective colors, and the above control is carried out on each developing unit 4 of each process unit P, whereby a stable image can be obtained when a multi-color image forming process is carried out or every time an image forming process for each color (Y, M, C, Bk) is carried out.

[Other Embodiments]

In each of the embodiments described above, when the toner specific concentration is corrected in conformity with the humidity variation in the case where the image density correction can be performed on the basis of the proper control of the developing bias output by detecting the test patch density, the correction of the toner specific concentration may be executed only when the developing bias value of the image density correction is varied from that of the previous image density correction by a predetermined value or more.

That is, at least the differential data of the developing bias value or both the previous and current developing bias values are stored in the storage unit 53*b* so that the variation amount from the developing bias value at the previous image density correction time can be determined at the current image density correction time.

The variation amount of the developing bias value is calculated from the differential data or developing bias values thus stored by the operating unit 53*c* or the like. The developing bias value thus calculated or stored is compared with the differential limited value which is stored in advance, and the toner specific concentration correction is executed only when the developing bias value is varied from the differential limited value by a predetermined value or more.

With the above construction, the toner specific concentration can be corrected only when the correction of the toner specific concentration is actually needed. Therefore, an unnecessary toner specific concentration correction can be prevented from being executed and thus an unnecessary stirring operation can be prevented from being carried out. In addition, the availability of the apparatus can be prevented from being reduced due to the execution of the toner specific concentration correction and the image density correction. The frequency of the toner specific concentration correction can be effectively reduced particularly when the image density correction or the toner specific concentration correction is carried out at plural times for every color.

In the foregoing description, the frequency of the toner specific concentration is reduced by focusing attention on the result of the image density correction, however, the frequency of the image density correction may be likewise reduced in accordance with the result of the toner specific concentration correction result. In this case, when the toner specific concentration correction amount exceeds the limit value thereof which is stored in advance, the processing of the image density correction is executed.

Further, in the case where the toner specific concentration is corrected in accordance with the humidity variation in the image forming apparatus 50 having the image density correction function described above, the toner specific concentration correction may be executed only when the developing bias value of the image density correction is varied from that of the previous image density correction for all the colors by a predetermined value or more or the average value of all the colors is varied by a predetermined value or more.

This construction makes it possible to judge that a slight correction is judged to be carried out for some developing agent materials of plural color developing agent materials and thus avoids occurrence of such a problem that the correction of the toner specific concentration is carried out on all the color developing agent materials to thereby cause the unnecessary developing agent stirring operation and the reduction of the availability, so that the toner specific concentration correction can be effectively carried out only when the toner specific concentration correction is actually needed.

Further, in the image forming apparatus 50 having the image density correction function, the correction of the toner specific concentration may be carried out on all the color developing agent materials when the toner specific concentration is corrected in accordance with the humidity variation.

In the image forming apparatus 50 in which a multicolor developing operation can be carried out, color balance is important, and it can be excellently kept by executing the toner specific concentration correction for all the color developing agent materials at the same time. Under certain circumstances, the frequency of the toner specific concentration correction may be reduced for colors to which human eyes are insensitive (for example, Y), and the maximum effect can be achieved with the minimum toner specific concentration correction.

What is claimed is:

1. An image forming apparatus comprising: a developing unit for stocking a developing agent containing toner and forming a toner image on a photosensitive medium with the developing agent;

a toner supply unit for supplying the toner to said developing unit;

a toner specific concentration detecting unit for detecting the toner specific concentration of the developing agent stocked in said developing unit;

a humidity detecting means for detecting humidity in the neighborhood of said developing unit;

a storage means for storing the humidity information detected by said humidity detecting unit; and a toner specific concentration correcting unit for controlling the toner supply amount of said toner supply unit on the basis of the humidity information stored to correct the toner specific concentration, wherein said toner specific concentration correcting unit compares newly-detected humidity with reference humidity corresponding to the humidity which is detected at the time when the developing agent is stocked into said developing unit or exchanged by new developing agent and which is stored in said storage unit, and corrects the toner specific concentration in accordance with the comparison result.

2. The image forming apparatus as claimed in claim 1, wherein said developing unit comprises a developing portion for forming a toner image on the photosensitive medium with the developing agent, a toner cartridge which is hermetically sealed so as to be openable while the developing agent containing at least the toner is stocked therein, and a developing agent feeding portion for feeding the toner in the opened toner cartridge to said developing portion, and said toner specific concentration unit corrects the toner specific concentration on the basis of reference humidity corresponding to the humidity of the interior and/or the exterior of said image forming apparatus which is detected by said humidity detecting unit just after the toner cartridge is opened.

3. The image forming apparatus as claimed in claim 1 or 2, further comprising a stirring unit for stirring the developing agent stocked in said developing unit, wherein said storage unit stores a stirring time of said stirring unit and a toner specific concentration which is newly detected by said toner specific concentration detecting unit, and said toner specific concentration correcting unit corrects the toner specific concentration on the basis of the stirring time and the comparison result for the humidity.

4. The image forming apparatus as claimed in claim 1, wherein said storage unit further stores the humidity at the time when the toner specific concentration is corrected as new reference humidity, and said toner specific concentration correcting unit compares the new reference humidity with humidity which is newly detected after the toner specific concentration is corrected and corrects the toner specific concentration in accordance with the comparison result.

5. The image forming apparatus as claimed in claim 1, further comprising a voltage applying unit for applying voltage to the developing agent stocked in said developing unit to adjust the density of the toner image, an image density detecting unit for detecting the density of the toner image, and an image density control means for comparing the image density detected by said image density detecting unit with a predetermined reference image density and setting the voltage applied by said voltage applying unit in accordance with the comparison result, wherein said storage unit stores the applied voltage thus set and the detected humidity as new reference humidity, and said toner specific concentration correcting unit compares the applied voltage newly set by said image density control unit with the previous applied voltage to judge the voltage correction direction, compares the newly detected humidity with the previous humidity to judge the humidity variation direction, and corrects the toner specific concentration only when the voltage correction direction corresponds to the humidity variation direction.

6. The image forming apparatus as claimed in claim 5, wherein said storage unit stores the applied voltage at the toner specific concentration correction time as a reference applied voltage, and said toner specific concentration correcting unit compares the applied voltage value newly set by said image density control unit with the reference applied voltage, corrects the toner specific concentration in accordance with the comparison result, and renews the reference applied voltage on the basis of the applied voltage at the toner specific concentration correcting time.

7. The image forming apparatus as claimed in claim 1, wherein said toner specific concentration correcting unit corrects the toner specific concentration only when the comparison result for the humidity is larger than a predetermined difference.

8. The image forming apparatus as claimed in claim 2, wherein said storage unit further stores the humidity at the time when the toner specific concentration is corrected as new reference humidity, and said toner specific concentration correcting unit compares the new reference humidity with humidity which is newly detected after the toner specific concentration is corrected and corrects the toner specific concentration in accordance with the comparison result.

9. The image forming apparatus as claimed in claim 3, wherein said storage unit further stores the humidity at the time when the toner specific concentration is corrected as new reference humidity, and said toner specific concentration correcting unit compares the new reference humidity with humidity which is newly detected after the toner specific concentration is corrected and corrects the toner specific concentration in accordance with the comparison result.

10. The image forming apparatus as claimed in claim 2, wherein said toner specific concentration correcting unit corrects the toner specific concentration only when the comparison result for the humidity is larger than a predetermined difference.

11. The image forming apparatus as claimed in claim 3, wherein said toner specific concentration correcting unit corrects the toner specific concentration only when the comparison result for the humidity is larger than a predetermined difference.

12. The image forming apparatus as claimed in claim 4, wherein said toner specific concentration correcting unit corrects the toner specific concentration only when the comparison result for the humidity is larger than a predetermined difference.

13. The image forming apparatus as claimed in claim 5, wherein said toner specific concentration correcting unit corrects the toner specific concentration only when the comparison result for the humidity is larger than a predetermined difference.

14. The image forming apparatus as claimed in claim 6, wherein said toner specific concentration correcting unit corrects the toner specific concentration only when the comparison result for the humidity is larger than a predetermined difference.

* * * * *